US005155000A

United States Patent [19]

Matsumura et al.

[11] Patent Number: 5,155,000

[45] Date of Patent: Oct. 13, 1992

[54] TONER COMPOSITION CONTAINING $TiO_2$ PARTICLES

[75] Inventors: Yasuo Matsumura; Takayoshi Aoki; Masayuki Takeda; Chiaki Suzuki; Ikutaroh Nagatsuka, all of Kanagawa, Japan

[73] Assignee: Fuji Xerox Co., Ltd., Tokyo, Japan

[21] Appl. No.: 436,128

[22] Filed: Nov. 14, 1989

Related U.S. Application Data

[63] Continuation of Ser. No. 143,874, Jan. 14, 1988, abandoned.

[30] Foreign Application Priority Data

Jan. 14, 1987 [JP] Japan ..... 62-5006

[51] Int. Cl.[5] ..... G03G 9/08; G03G 9/09

[52] U.S. Cl. ..... 430/110; 430/106

[58] Field of Search ..... 430/110

[56] References Cited

U.S. PATENT DOCUMENTS

| | | | |
|---|---|---|---|
| 2,009,436 | 7/1935 | Coolidge | 106/447 |
| 2,068,066 | 1/1937 | O'Brien | 106/447 X |
| 3,320,169 | 5/1967 | East | 430/110 |
| 3,558,492 | 1/1971 | Proskow | 430/109 X |
| 3,983,045 | 9/1976 | Jungle | 430/110 |
| 4,262,077 | 4/1981 | Ito | 430/110 X |

*Primary Examiner*—Roland Martin

*Attorney, Agent, or Firm*—Sughrue, Mion, Zinn, Macpeak & Seas

[57] ABSTRACT

A dry toner composition containing titanium dioxide particles, the surfaces of the particles comprising an organic compound having a melting point of from about 40° C. to about 150° C.

9 Claims, No Drawings

TONER COMPOSITION CONTAINING $TiO_2$ PARTICLES

This is a continuation, of application Ser. No. 07/143,874, filed Jan. 14, 1988, now abandoned.

FIELD OF THE INVENTION

The present invention relates to a dry toner composition which is used for developing electrostatically charged images in both electrophotography and electrostatic recording methods.

BACKGROUND OF THE INVENTION

In electrophotography, an image copy can be obtained by developing electrostatically charged images formed on a photoreceptor with resin particles generally containing pigments (hereinafter "toners") to visualize the images, transferring the visual images onto a paper, and fixing the resulting images with a heated roll.

The photoreceptor then undergoes cleaning to again form electrostatically charged images thereon.

It is necessary that toners used for such electrostatic development have characteristics suitable for duplicating processes such as flowability, caking resistance, the ability to adequately fix images, electrical charging properties, and cleaning ability.

The addition of fine particles of inorganic substances such as silica, alumina or titania to toner composition has generally been performed, particularly to increase flowability and caking resistance among the above characteristics.

However, dispersibility of such fine particles of inorganic substances often depends upon the surface structure of the fine particles. When dispersibility is poor, satisfactory flowability and caking resistance cannot be obtained, cleaning is incomplete, toners firmly adhere on a photoreceptor, thereby forming black spots on image copies, and electrical charging properties of a developer decreases with passage of time.

Accordingly, the primary objects of the present invention are to solve the above described problems caused when inorganic fine particles are incorporated in toners.

SUMMARY OF THE INVENTION

A primary object of the present invention is to provide a toner composition having excellent flowability and caking resistance.

A second object of the present invention is to provide a toner composition capable of being easily cleaned.

Another object of the present invention is to provide a toner composition which hardly generates black spots which are caused because of firm adhesion of toners on a photoreceptor.

Still another object of the present invention is to provide a toner composition whose developing ability is stable and does not deteriorate over time.

The above and other objects of the present invention can be attained by adding fine particles of titanium oxide coated with organic compounds having a predetermined melting point range (from about 40° to about 150° C.) to toners. That is, the present invention relates to a dry toner composition containing a toner and fine particles of titanium dioxide the surface of which comprises organic compounds having a melting point of from about 40° to about 150° C.

DETAILED DESCRIPTION OF THE INVENTION

Titanium dioxide has conventionally been used as an additive for electrophotographic toner compositions. However, titanium dioxide is often used as it is, that is, the surface thereof is untreated. In some cases, titanium dioxide is used after being treated with various coupling agents to make the surface thereof hydrophobic, or is treated to coat the surface thereof with alumina. Untreated titanium dioxide or alumina-treated titanium dioxide is readily available in practice, but is not effective in preventing titanium dioxide particles from coagulating. Further, dispersibility of such untreated or alumina-treated titanium dioxide is poor upon being added to toners. Surface treatment with a coupling agent on the titanium dioxide particles is effective to improve charging characteristics, but the problem of heavy coagulation of titanium dioxide occurs during the surface treatment. Thus, these types of untreated and treated titanium dioxide particles are undesirable in view of such problems.

On the other hand, in accordance with the present invention, surface treatment with organic compounds such as fatty acids or aliphatic alcohols is easy to perform and is effective to improve dispersibility of the titanium dioxide particles and to prevent the particles coagulating as long as the melting point range of organic compounds is predetermined.

The melting point of the organic compounds with which titanium dioxide particles are coated must be about 40° C. or higher in view of the storage stability of surface-coated titanium dioxide itself as well as the storage stability of surface-coated titanium dioxide which has been added to toners. When the melting point of the organic compounds is below about 40° C., surface-coated titanium dioxide particles tend to coagulate.

When the melting point of the organic compounds is above about 150° C., heating necessary for surface treatment is difficult and surface coating of the particles is not uniform, whereby the above desirable characteristics cannot be obtained.

Specific examples of the organic compounds used for the surface treatment in accordance with the present invention are illustrated below:

(1) Saturated fatty acids having from 13 to 39 carbon atoms such as lauric acid, tridecanoic acid, myristic acid, pentadecanoic acid, palmitic acid, margaric acid, stearic acid, nonadecanoic acid, arachidic acid, behenic acid, lignoceric acid, cerotic acid, montanic acid, melissic acid or the like.

(2) Normal acetylene fatty acids having from 11 to 22 carbon atoms such as tariric acid, stearolic acid, or behenolic acid.

(3) ω-phenyl fatty acids represented by the formula $C_6H_5(CH_2)_{n-1}COOH$ (n=2 or 3).

(4) ω-cyclohexyl fatty acids represented by the formula $C_6H_{11}(CH_2)_{n-1}COOH$ ($n \geqq 10$).

(5) Fatty acid esters.

(6) Various mono-, di- or triglycerides and trimethylol propane.

(7) Aliphatic alcohols having 15 or more carbon atoms such as pentadecanol, cetyl alcohol, heptadecanol, octadecanol, nonadecanol or eicosanol.

(8) Fatty acid amides such as stearic acid amide, oleic acid amide, erucic acid amide, lauric acid amide, palmitic acid amide or ricinoleic acid amide.

Of these, the compounds of (6), (7) and (8) are preferred, and trimethylol propane, cetyl alcohol, stearic acid amide, oleic acid amide and ricinoleic acid amide are particularly preferred.

Titanium dioxide particles to be coated with the organic compound may have either a rutile structure or an anatase structure, and the primary particle size thereof, prior to the surface treatment, is preferably about 1.0 μm or lower, more preferably 0.3 μm or lower.

Titanium dioxide particles can be coated with the organic compound by various methods such as spraying, dipping, fluidized bed coating, tumbling, brushing, mixing and the like. The organic compound may be applied as a powder, a dispersion, solution, emulsion or hot melt. When applied as a solution, any suitable solvent may be employed. Solvents having relatively low boiling points are preferred because less energy and time are required to remove the solvent, subsequent to application of the coating to the titanium dioxide particles.

It is necessary to uniformly mix the titanium dioxide particles and the organic compound so as to form a uniform coating of the organic compound on the surface of this particles. For the purpose, a mixing method is preferably conducted using a V-type mixing device, a Henschel mixer, a ball mill and the like, and the Henschel mixer is preferred because of its high coefficient of stirring. When the organic compound has a high melting point, mixing is preferably conducted with heating. One method for coating the titanium dioxide particles with the organic compound comprises , for example, dissolving or dispersing the organic compound in a solvent, if desired, mixing the titanium dioxide particles and the organic compound in a dispersing device such as a Henschel mixer, under heating, followed by cooling, and removing the solvent, whereby the organic compound is firmly coated on the surface of the titanium oxide particles. The titanium dioxide and organic compounds may or may not be chemically bonded to each other after such surface treatment.

In the present invention, the amount of such surface-coated titanium dioxide particles to be added to dry toners is from about 0.1 to about 5 wt %, preferably from 0.5 to 3 wt %, based on the toners.

Toners which can be used in the present invention are those comprising a mixture of carbon black or other coloring agents and various known resinous binders such as a styrene-acrylate type, a polyester type, a styrene-butadiene type, an olefin type, a polyamide type, an epoxy type or a ketone type, which may also contain magnetic particles.

In more detail, any suitable vinyl resin having a melting point of at least about 110° F. may be employed as the binder. The vinyl resin may be a homopolymer or a copolymer of two or more vinyl monomers. Typical monomeric units which may be employed to form vinyl polymers include: styrene, p-chlorostyrene, vinyl naphthalene; ethylenically unsaturated monoolefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of α-methylene aliphatic monocarboxylic acids such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrole, N-vinyl carbazole, N-vinyl indole, N-vinyl pyrrolidine and the like, and mixtures thereof. Generally, suitable vinyl resins employed in the toner have a weight average molecular weight between about 3,000 to about 500,000.

Binders containing relatively high percentages of a styrene resin are preferred. The presence of a styrene resin is preferred because a greater degree of image definition is generally achieved upon latent image development. Further, denser images are obtained when at least about 25% by weight, based on the total weight of resin in the toner, of a styrene resin is present in the toner. The styrene resin may be a homopolymer of styrene or styrene homologues or copolymers of styrene with other monomeric groups containing a single methylene group attached to a carbon atom by a double bond. Thus, typical monomeric materials which may be copolymerized with styrene by addition polymerization include: p-chlorostyrene, vinyl naphthalene, ethylenically unsaturated monoolefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of α-methylene aliphatic monocarboxylic acids such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrole, N-vinyl carbazole, N-vinyl indole, N-vinyl pyrrolidine and the like; and mixtures thereof. The styrene resins may also be formed by the polymerization of mixtures of two or more of these unsaturated monomeric materials with a styrene monomer. The expression "addition polymerization" is intended to include known polymerization techniques such as free radical, anionic and cationic polymerization processes.

The vinyl resins, including styrene type resins, may also be blended with one or more other resins if desired. When the vinyl resins is blended with another resin, the added resin is preferably another vinyl resin because the resulting blend is characterized by especially good triboelectric stability and uniform resistance against physical degradation. The vinyl resins employed for blending with the styrene type or other vinyl resin may be prepared by the addition polymerization of any suitable vinyl monomer such as the vinyl monomers described above. Other thermoplastic resins may also be blended with the vinyl resins of this invention. Typical non-vinyl type thermoplastic resins include: rosin-modified phenol-formaldehyde resins, oil-modified epoxy resins, polyurethane resins, cellulosic resins, polyether resins and mixtures thereof. When the resin component of the toner contains styrene copolymerize with another unsaturated monomer or a blend of polystyrene and another resin, a styrene component of at least about 25% by weight based on the total weight of the resin present in the toner is preferred because denser images are obtained and a greater degree of image definition is achieved with a given quantity of toner material.

It is to be understood that the resins of the toner do not exclude the presence of monomeric units or reactants other than those which have been described. For example, some commercial materials contain trace amounts of homologues or unreacted or partially reacted monomers. Any minor amount of such substituents may be present in the toner of this invention.

Any suitable pigment or dye may be employed as the colorant for the toner particles. Toner colorants are well-known and include, for example, carbon black, nigrosine dye, aniline blue, Calco Oil Blue, chrome yellow, ultramarine blue, duPont Oil Red, Quinoline Yellow, methylene blue chloride, phthalocyanine blue, Malachite Green Oxalate, lamp black, Rose Bengal and mixtures thereof. The pigment or dye should be present in the toner in a quantity sufficient to render it highly colored so that it will form a clearly visible image on a recording member. Thus, for example, where conventional electrostatographic copies of typed documents are desired, the toner may comprise a black pigment such as carbon black, for example, furnace black or channel black, or a black dye such as Amaplast Black dye, available from National Aniline Products, Inc. Generally, the pigment is employed in an amount from about 1% to about 20% by weight based on the total weight of the colored toner. If the toner colorant employed is a dye, substantially smaller quantities of colorant may be used. However, since a number of the above pigments used in an electrostatographic toner may affect both the glass transition and fusion temperatures of the toner of this invention, their concentration preferably should be less than about 10% by weight of the colored toner. Representative patents in which toner and developer materials are disclosed include U.S. Pat. Nos. 2,788,288, 3,079,342, 3,577,345, 3,653,893, 3,590,000, 3,655,374, 3,720,617, and 3,819,367, and U.S. Pat. No. 25,136. Especially preferred for use in the present invention are those compositions disclosed in U.S. Reissue Patent 25,136 and U.S. Pat. No. 3,079,342 containing a copolymer of styrene and alkyl methacrylate; the compositions disclosed in U.S. Pat. No. 3,590,000 comprising a solid, stable hydrophilic metal salt of a fatty acid such as zinc stearate, and a polymeric esterification product of a dicarboxylic acid and a diol comprising a diphenol; and the compositions disclosed in U.S. Pat. No. 3,819,367 containing a minor proportion of sub-microscopic silican dioxide additive particles.

The toner may be prepared by a well-known toner mixing and comminution technique. For example, the ingredients may be thoroughly mixed by blending, mixing and milling the components and thereafter micropulverizing the resulting mixture. Another well-known technique for forming toner particles is to spray-dry a ball-milled toner composition comprising a colorant, a resin, and a solvent.

The toner composition of the present invention can be used with a carrier to constitute a two-component type developer. Conventional carriers can be used, such as known iron powders, ferrite powders and those coated with various resins such as an acrylate type, a pyridine type, a pyrrolidone type or a fluorine type. A carrier comprising magnetic powders fixed with a suitable binder can also be used, if desired.

In more detail, any suitable coated or uncoated electrostatographic carrier bead material may be employed as the carrier material of this invention. Typical carriers include sodium chloride, ammonium chloride, aluminum potassium chloride, Rochelle salt, sodium nitrate, aluminum nitrate, potassium chlorate, granular zircon, granular silicon, methyl methacrylate, glass and silicon dioxide. Typical magnetic brush development process carriers include nickel, steel, iron, ferrites, and the like, and are preferred. The carriers may be employed with or without a coating. Many of the foregoing and other typical carriers are described by L. E. Walkup et al in U.S. Pat. No. 2,638,416 and E. N. Wise in U.S. Pat. No. 2,618,552. Additionally, it is preferred that the carrier materials have semi-conductive to conductive properties. Where desired, the carrier materials may be coated with any suitable insulating material. Typical electrostatographic carrier particle coating materials include vinyl chloride-vinyl acetate copolymers, styrene-acrylate-organosilicon terpolymers, natural resins such as caoutchouc, colophony, copal, dammar, jalap, storax; thermoplastic resins including the polyolefins such as polyethylene, polypropylene, chlorinated polyethylene, and chlorosulfonated polyethylene; polyvinyls and polyvinylidenes such as polystyrene, polymethylstyrene, polymethyl methacrylate, polyacrylonitrile, polyvinyl acetate, polyvinyl alcohol, polyvinyl butyral, polyvinyl chloride, polyvinyl carbazole, polyvinyl ethers, and polyvinyl ketones; fluorocarbons such as polytetrafluoroethylene, polyvinyl fluoride, polyvinylidene fluoride; and polychlorotrifluoroethylene; polyamides such as polycaprolactam and polyhexamethylene adipamide; polyesters such as polyethylene terephthalate; polyurethanes; polysulfides, polycarbonates, thermosetting resins including phenolic resins such as phenol-formaldehyde, phenol-furfural and resorcinol formaldehyde; amino resins such as urea-formaldehyde and melamine-formaldehyde; polyester resins; epoxy resins; and the like. Many of the foregoing and other typical carrier coating materials are described by L. E. Walkup in U.S. Pat. No. 2,618,551; B. B. Jacknow et al. in U.S. Pat. No. 3,526,433; and R. J. Hagenbach et al. in U.S. Pat. Nos. 3,533,835 and 3,658,500.

When the carrier materials of this invention are coated, any suitable electrostatographic carrier coating thickness may be employed. However, a carrier coating having a thickness of at least sufficient to form a thin film on the carrier particle is preferred because the carrier coating will then possess sufficient thickness to resist abrasion and prevent pinholes which adversely affect the triboelectric properties of the coated carrier particles. Generally, for cascade and magnetic brush development, the carrier coating may comprise from about 0.1% to about 10.0% by weight based on the weight of the coated carrier particles. Preferably, the carrier coating should comprise from about 0.3% to about 1.5% by weight based on the weight of the coated carrier particles because maximum durability, toner impaction resistance, and copy quality are achieved. To achieve further variation in the properties of the coated composite carrier particles, well-known additives such as plasticizers, reactive and non-reactive polymers dyes, pigments, wetting agents and mixtures thereof may be mixed with the coating materials and the coating may be continuous or discontinuous.

The toner composition of the present invention can be applied to conventional photoreceptors to develop an electrostatically charged image formed thereon. Any suitable organic or inorganic photoconductive material may be employed in the photoreceptor. Typical inorganic photoconductor materials include: sulfur, selenium, zinc sulfide, zinc oxide, zinc cadmium sulfide, zinc magnesium oxide, cadmium selenide, zinc silicate, calcium strontium sulfide, cadmium sulfide, mercuric iodide, mercuric oxide, mercuric sulfide, indium trisulfide, gallium selenide, arsenic disulfide, arsenic trisulfide, arsenic triselenide, antimony trisulfide, cadmium sulfo-selenide and mixtures thereof.

Typical organic photoconductors include: quinacridone pigments, phthalocyanine pigments, triphenylamine, 2,4-bis(4,4'-diethylamino-phenol)-1,3,4-oxadiazol, N-isopropylcarbazole, triphenylpyrrole, 4,5-diphenylimidazolidinone, 4,5-diphenyl-imidazolidinethione, 4,5-bis(4'-aminophenyl)imidazolidinone, 1,5-dicyanonaphthalene, 1,4-dicyanonaphthalene, aminophthalodinitrile, nitrophthalodinitrile, 1,2,5,6-tetraazacyclooctatetracene-(2,4,6,8), 2-mercaptobenzothiazole-2-phenyl-4-bisphenylideneoxazolone, 6-hydroxy2,3-di(p-methoxyphenyl)benzofurane, 4-dimethylaminobenzylidene-benzhydrazide, 3-benzylideneaminocarbazole, polyvinyl (2-nitrobenzylidene)-p-bromoaniline, 2,4-diphenylquinazoline, 1,2,4-triazine, 5-diphenyl-3-methyl-pyrazoline, 2-(4'-dimethylaminophenyl)benzoxazole, 3-aminocarbazole, and mixtures thereof. Other organic photoconductors as disclosed in U.S. Pat. Nos. 4,562,132, 4,559,286, 4,557,989, 4,552,822, 4,555,822 and 4,555,463 may also be employed.

Suitable known methods of cleaning the photoreceptor which prominently exhibit the excellent effects of the toner composition of the present invention include a blade cleaning method, a brush cleaning method, a web cleaning method, a magbrush cleaning method and the like.

EXAMPLE 1

3 wt % of cetyl alcohol based on untreated titanium dioxide particles ("P25" manufactured by Nippon Aerosil Co., Ltd., average particle size 30 mμ) was dissolved in methylene chloride and was mixed with the titanium dioxide particles in a Henschel mixer with vigorous stirring, while the chamber temperature was raised to 110° C. with steam. Thereafter, methylene chloride was completely removed under reduced pressure. Coagulation was hardly observed. The thus treated titanium dioxide particles in an amount of 0.8 wt % were mixed with toners (styrene/n-butyl methacrylate copolymer (molar ratio 7:3) 89.2 wt %, carbon black 10 wt %, nigrosine 0.8 wt %) by a V-type mixing device. The surface of a resulting toner composition was observed with a scan-type electron microscope, and it was observed that the titanium dioxide particles were uniformly coated with the organic compound, cetyl alcohol.

The resulting toner composition was then mixed with ferrite carriers coated with a fluorine type resin, and image duplication was conducted by a modified machine of FX3500 (manufactured by Fuji Xerox Co., Ltd.) using the thus prepared two-component type developer. Images were clear, the cleaning process was complete by a cleaning blade method and black spots were not observed after 40,000 copies were made.

For comparison, similar duplication was conducted using untreated titanium dioxide particles, and as a result, black spots were observed after only 20,000 copies. Further, when toners to which the titanium dioxide particles were not added were used, the toners were solidified and adhered in a toner box and therefore toners could not be constantly supplied.

EXAMPLE 2

In the same manner as in Example 1, titanium dioxide particles were treated using trimethylol propane (chamber temperature 90° C.). The copy test was conducted using the surface-coated titanium dioxide particles under the same conditions as in Example 1, and then excellent results were obtained similar to Example 1.

EXAMPLE 3

Untreated titanium dioxide particles were surface-treated in the same manner as in Example 1 except that no methylene chloride was used, 1.0 wt % stearic acid amide was used in place of 3 wt % of cetyl alcohol, and the chamber temperature was raised to 140° C. The resultant titanium dioxide was not placed under reduced pressure after mixing.

The copy test was conducted using the thus obtained surface-treated titanium dioxide particles under the same conditions as in Example 1. As a result, black spots were not observed even after 30,000 copies which had good image qualities.

As illustrated above, in accordance with the present invention, coagulation of titanium dioxide particles can be effectively prevented by treating the surface of titanium dioxide particles with an organic compound having a melting point of from about 40° to about 150° C.

Accordingly, the toner composition of the present invention have very desirable characteristics, i.e., the toners have excellent flowability and caking resistance, can easily be cleaned, black spots caused by adhesion of toners on a photoreceptor hardly occur and developing ability hardly deteriorates over time.

While the invention has been described in detail and with reference to specific embodiments thereof, it will be apparent to one skilled in the art that various changes and modifications can be made therein without departing from the spirit and scope thereof.

What is claimed is:

1. A toner composition comprising a mixture of toner particles containing a colorant and a binder resin and titanium dioxide particles provided with a surface coating of an organic compound having a melting point of from about 40° C. to about 150° C. to prevent coagulation of the titanium dioxide particles.

2. A toner composition as in claim 1, wherein said titanium dioxide particles are present in an amount of from about 0.1 to about 5 wt % based on said toner.

3. A toner composition as in claim 2, wherein said amount is from 0.5 to 3 wt %.

4. A toner composition as in claim 1, wherein said organic compound is at least one compound selected from the group consisting of saturated fatty acids having from 13 to 39 carbon atoms, normal acetylene fatty acids having from 11 to 22 carbon atoms, ω-phenyl fatty acids represented by the formula $$C_6H_5(CH_2)_{n-1}COOH \ (n=2 \text{ or } 3),$$

ω-cyclohexyl fatty acids represented by the formula $C_6H_{11}(CH_2)_{n-1}COOH$ ($n \geqq 10$), fatty acid esters, mono-, di- or tri-glycerides, trimethylol propane, aliphatic alcohols having 15 or more carbon atoms, and fatty acid amides.

5. A toner composition as in claim 4, wherein said organic compound is at least one compound selected from the group consisting of trimethylol propane, cetyl alcohol, stearic acid amide, oleic acid amide, and ricinoleic acid amide.

6. A toner composition as in claim 1, wherein said titanium dioxide comprises a rutile structure or an anatase structure and said particles have a primary particle size of about 1.0 μm or lower.

7. A toner composition as in claim 1, wherein said organic compound has been coated over substantially the entire surface of the titanium dioxide particles.

8. A toner composition as in claim 1, wherein said organic compound is cetyl alcohol or trimethylol propane.

9. A toner composition as in claim 1, wherein the surface coating provided on said titanium dioxide particles is uniform.

* * * * *